US010096911B2

(12) United States Patent
Tao et al.

(10) Patent No.: US 10,096,911 B2
(45) Date of Patent: Oct. 9, 2018

(54) DUAL-BAND ANTENNA AND ANTENNA SYSTEM

(71) Applicant: Wistron NeWeb Corporation, Hsinchu (TW)

(72) Inventors: Yu Tao, Hsinchu (TW); Shang-Sian You, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 89 days.

(21) Appl. No.: 15/132,246

(22) Filed: Apr. 19, 2016

(65) Prior Publication Data

US 2016/0322704 A1 Nov. 3, 2016

Related U.S. Application Data

(60) Provisional application No. 62/154,743, filed on Apr. 30, 2015.

(30) Foreign Application Priority Data

Dec. 24, 2015 (CN) ..... 2015 1 0979677

(51) Int. Cl.

| | |
|---|---|
| ***H01Q 9/16*** | (2006.01) |
| ***H01Q 25/00*** | (2006.01) |
| ***H01Q 9/04*** | (2006.01) |
| ***H01Q 9/36*** | (2006.01) |
| ***H01Q 21/30*** | (2006.01) |
| *H01Q 1/22* | (2006.01) |

(52) U.S. Cl.
CPC ..... *H01Q 25/00* (2013.01); *H01Q 9/0421* (2013.01); *H01Q 9/36* (2013.01); *H01Q 21/30* (2013.01); *H01Q 1/2291* (2013.01)

(58) Field of Classification Search
CPC ..... H01Q 21/24; H01Q 1/48; H01Q 25/00; H01Q 9/36; H01Q 21/30; H01Q 9/0421; H01Q 1/2291
See application file for complete search history.

(56) References Cited

U.S. PATENT DOCUMENTS

| | | | |
|---|---|---|---|
| 6,646,614 | B2 | 11/2003 | Killen |
| 2004/0217910 | A1 | 11/2004 | Montgomery |
| 2005/0057400 | A1 | 3/2005 | Yuanzhu |
| 2010/0103066 | A1 | 4/2010 | Shtrom |
| 2010/0119002 | A1 | 5/2010 | Hartenstein |

(Continued)

FOREIGN PATENT DOCUMENTS

| | | |
|---|---|---|
| CN | 202423542 U | 9/2012 |
| DE | 103 03 540 A1 | 8/2004 |

(Continued)

*Primary Examiner* — Dieu H Duong
(74) *Attorney, Agent, or Firm* — Winston Hsu

(57) ABSTRACT

The present invention discloses a dual-band antenna. The dual-band antenna includes a first radiating element and a second radiating element. The first radiating element is parallel to a first plane, operates at a first frequency band, and has a first edge and a second edge. The first edge and the second edge are connected through a central portion. The second radiating element is parallel to a second plane, adjacent to the first edge, the second edge and a first side of the central portion, and operates at a second frequency band, where the first plane is perpendicular to the second plane.

12 Claims, 4 Drawing Sheets

(56) References Cited

U.S. PATENT DOCUMENTS

| | | | | |
|---|---|---|---|---|
| 2010/0309062 | A1* | 12/2010 | Chang | H01Q 1/42 343/702 |
| 2010/0315313 | A1 | 12/2010 | Wu | |
| 2011/0018780 | A1 | 1/2011 | Tassoudji | |
| 2012/0139806 | A1 | 6/2012 | Zhan | |
| 2013/0064149 | A1* | 3/2013 | Huang | H01Q 13/10 370/297 |
| 2013/0162499 | A1 | 6/2013 | Pochop, Jr. | |
| 2013/0321240 | A1 | 12/2013 | O'Shea | |
| 2014/0197998 | A1 | 7/2014 | Govindasamy | |

FOREIGN PATENT DOCUMENTS

| | | | |
|---|---|---|---|
| JP | 2003188642 | A | 7/2003 |
| JP | 2008503941 | A | 2/2008 |

* cited by examiner

DUAL-BAND ANTENNA AND ANTENNA SYSTEM

CROSS REFERENCE TO RELATED APPLICATIONS

This application claims the benefit of U.S. provisional application No. 62/154,743, filed on Apr. 30, 2015 and incorporated herein by reference.

BACKGROUND OF THE INVENTION

1. Field of the Invention

The present invention relates to a dual-band antenna and an antenna system, and more particularly, to a dual-band antenna and an antenna system capable of reducing interference.

2. Description of the Prior Art

As the wireless communication technology evolves, the demand for wireless networks increases. In the next generation, a standard of IEEE 802.11ac, exploiting multi-user multiple input multiple output (MU-MIMO) technology to enhance transmission rate, is widely adopted by the industry for communication products in wireless local area network (WLAN).

The operational frequency of wireless devices under the 802.11ac standard is mainly at 5 GHz. However, high frequency operation brings high scattering effect, which shortens a transmission range of the wireless devices. To achieve both high data rate and long transmission range, the wireless device under a WLAN, such as a wireless router, a wireless base station, a wireless access point, etc., may operate both at 2.4 GHz as well as 5 GHz. In another perspective, the wireless devices are usually equipped with multiple antennas. Some of the antennas may operate at both 2.4 GHz and 5 GHz, and some of the antennas may operate at 5 GHz. Due to the limited disposition space of the antennas, the antennas operating at both 2.4 GHz and 5 GHz would be easily interfered by the antennas operating at 5 GHz. Hence, it is necessary to improve the prior art.

SUMMARY OF THE INVENTION

It is therefore a primary objective of the present invention to provide a dual-band antenna and an antenna system capable of reducing interference, to improve over disadvantages of the prior art.

An embodiment of the present invention discloses a dual-band antenna comprising a first radiating element parallel to a first plane, operating at a first frequency band, wherein the first radiating element comprises a first edge and a second edge, and the first edge, the second edge are connected through a central portion; and a second radiating element parallel to a second plane, operating at a second frequency band, adjacent to the first edge, the second edge and a first side of the central portion; wherein the first plane is perpendicular to the second plane.

An embodiment of the present invention further discloses an antenna system comprising at least a dual-band antenna, each comprising a first radiating element parallel to a first plane, operating at a first frequency band, wherein the first radiating element comprises a first edge and a second edge, and the first edge, the second edge are connected through a central portion; and a second radiating element parallel to a second plane, operating at a second frequency band, adjacent to the first edge, the second edge and a first side of the central portion; wherein the first plane is perpendicular to the second plane; and a radio frequency (RF) processing module, coupled to the at least a dual-band antenna.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
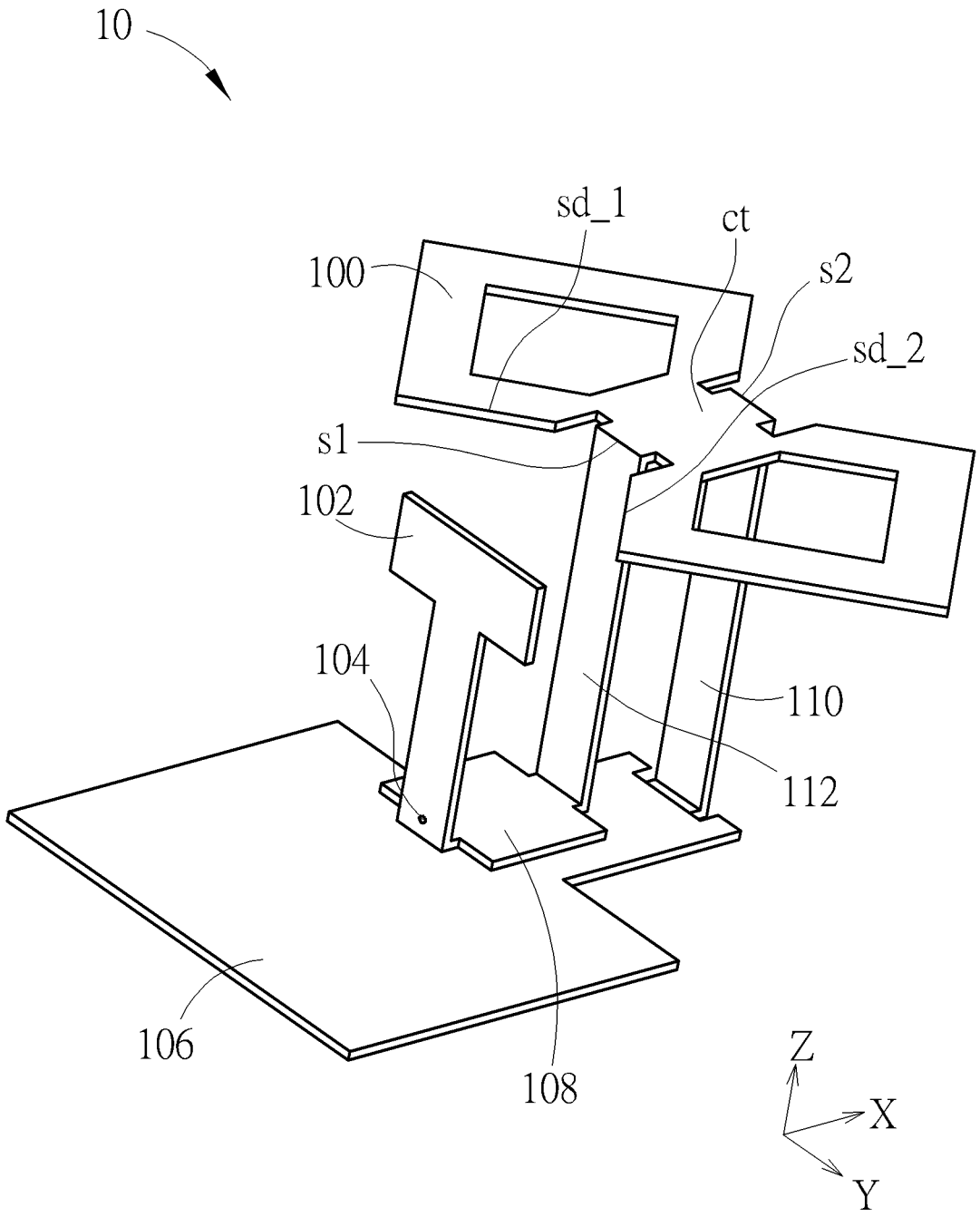
FIG. 1A is a schematic diagram of an isometric view of a dual-band antenna according to an embodiment of the present invention.
Figure 1B:
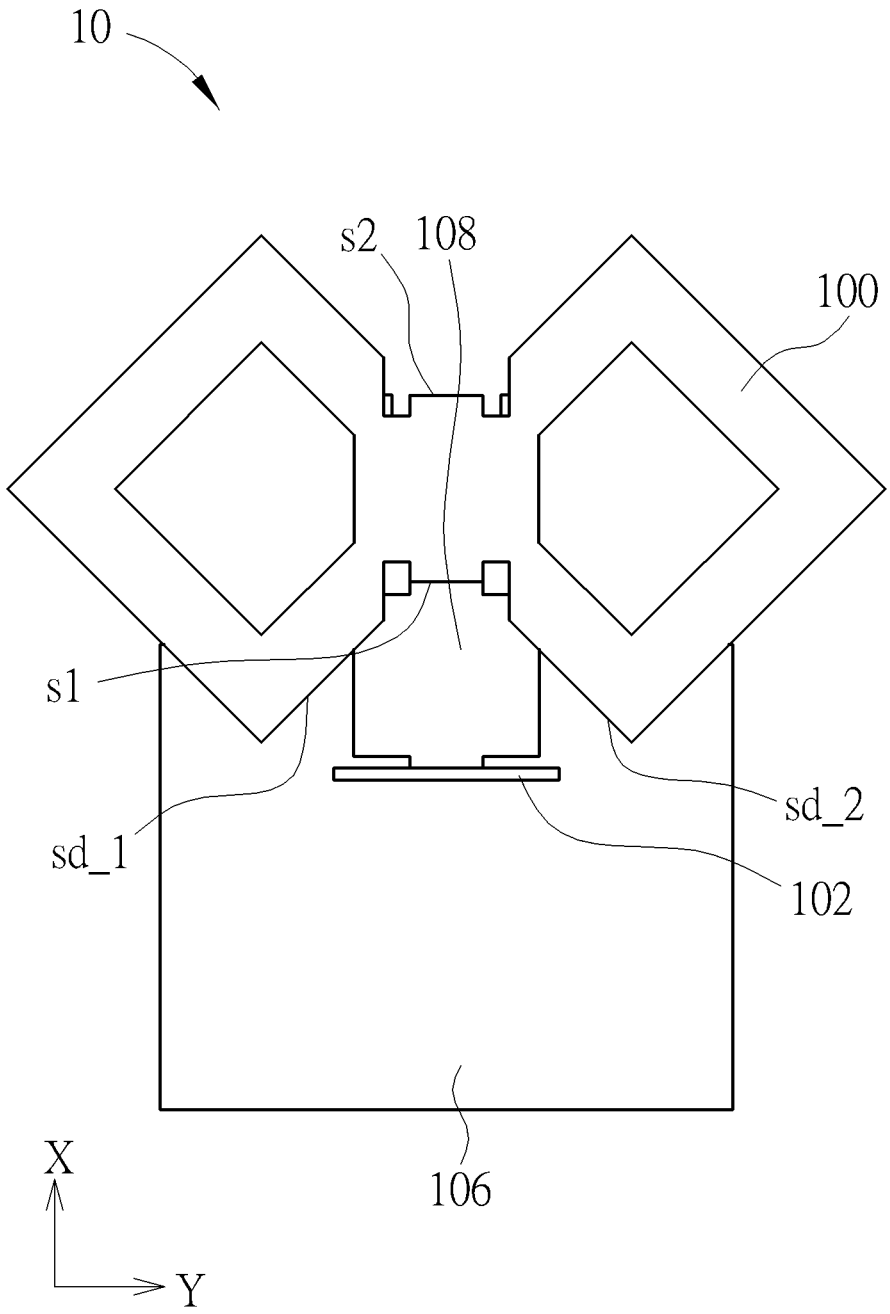
FIG. 1B is a schematic diagram of a top view of the dual-band antenna in FIG. 1A.
Figure 1C:
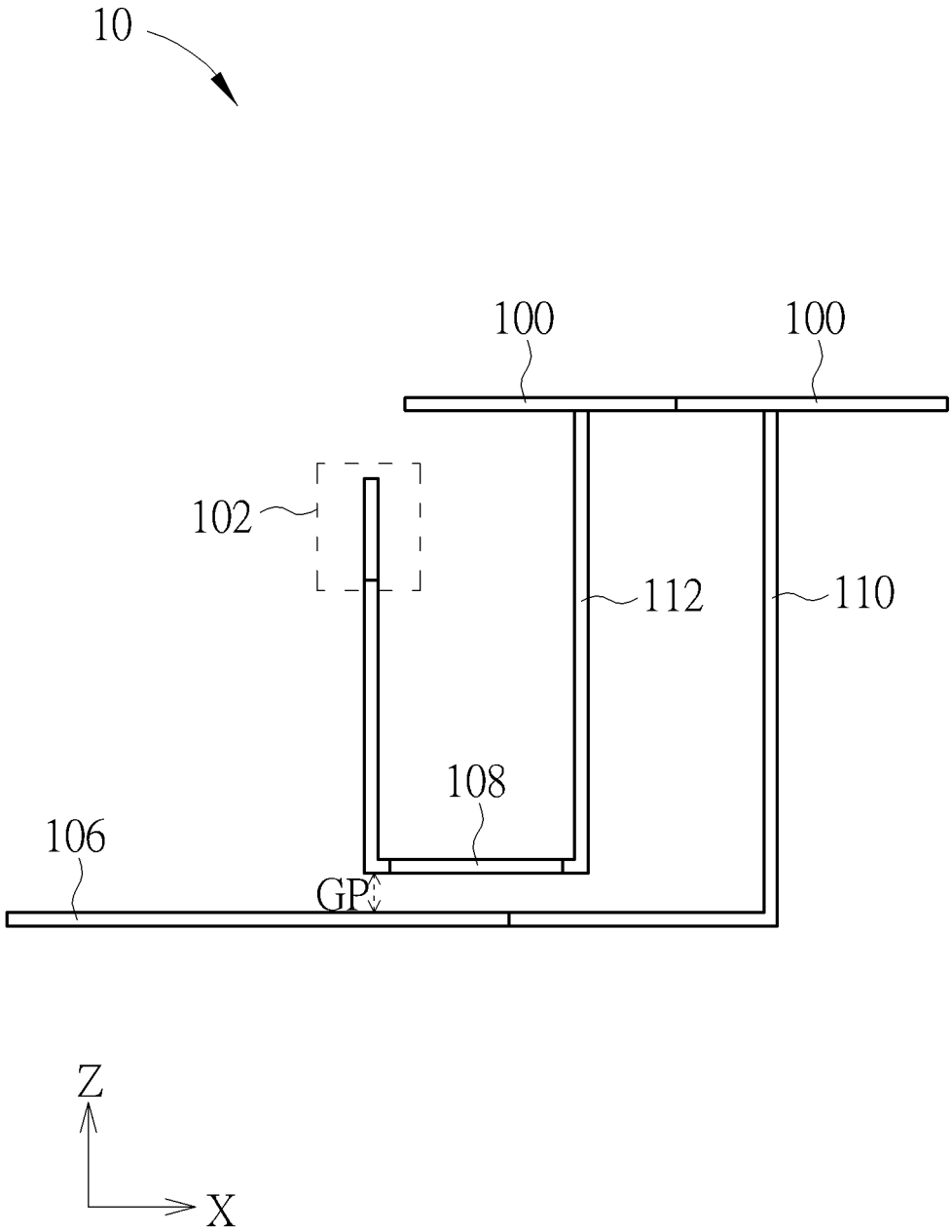
FIG. 1C is a schematic diagram of a side view of the dual-band antenna in FIG. 1A.

FIGS. 1A-1C are schematic diagrams of an isometric view, a top view, and a side view, respectively, of a dual-band antenna 10 according to an embodiment of the present invention. A coordination system labeled by X, Y and Z axes is included in FIGS. 1A-1C, for illustrative purpose. As shown in FIGS. 1A-1C, the dual-band antenna 10 comprises a first radiating element 100, a second radiating element 102, a grounding element 106, a matching element 108, a shorting element 110 and a connecting element 112. The first radiating element 100, parallel to an XY plane (corresponding to the first plane specified in the claims), operates at a first frequency band. The first radiating element 100 has a symmetric structure. Specifically, the first radiating element 100 may be in a shape of a double-diamond, i.e., the first radiating element 100 may comprise two diamond-shaped radiating parts, and the two diamond-shaped radiating parts are connected through the vertices thereof. The first radiating element 100 has edges sd_1, sd_2 and a central portion ct. The edges sd_1, sd_2 are connected through the central portion ct of the first radiating element 100. The second radiating element 102 may be in a T-shape. The second radiating element 102, parallel to an YZ plane (corresponding to the second plane specified in the claims), operates at a second frequency band. The dual-band antenna 10 may be fed-in through a fed-in point 104 at a bottom of the second radiating element 102. The second radiating element 102 is disposed between and adjacent to the edges sd_1, sd_2. Furthermore, the second radiating element 102 is also adjacent to a first side s1 of the central portion ct. The grounding element 106 and the matching element 108 are both parallel to the XY plane. A gap GP is between the grounding element 106 and the matching element 108. The shorting element 110 and the connecting element 112 are both parallel to the YZ plane. The shorting element 110 is configured to connect a second side s2 of the central portion ct of the first radiating element 100 and the grounding element 106. The connecting element 112 is configured to connect the first side s1 of the central portion ct of the first radiating element 100 and the matching element 108. The second radiating element 102 is connected to the matching element 108.

Notably, the dual-band antenna 10 would mainly generate a polarization direction parallel to the YZ plane. Specifically, due to the symmetric structure of the first radiating element 100, electromagnetic energy emitted by the first radiating element 100, parallel to the XY plane, may be counteracted and hardly affect the electromagnetic energy emitted by the second radiating element 102, having a polarization direction parallel to the YZ plane. In an embodiment, the dual-band antenna 10 may be a vertically polarized antenna. Although the first radiating element 100 emits electromagnetic energy in a horizontally polarized direction, horizontal components of the electromagnetic energy emitted by the first radiating element 100 would be counteracted due to the symmetric structure of the first radiating element 100. Hence, vertical components of the electromagnetic energy emitted by the dual-band antenna 10 would larger than the horizontal components thereof.

Figure 2:
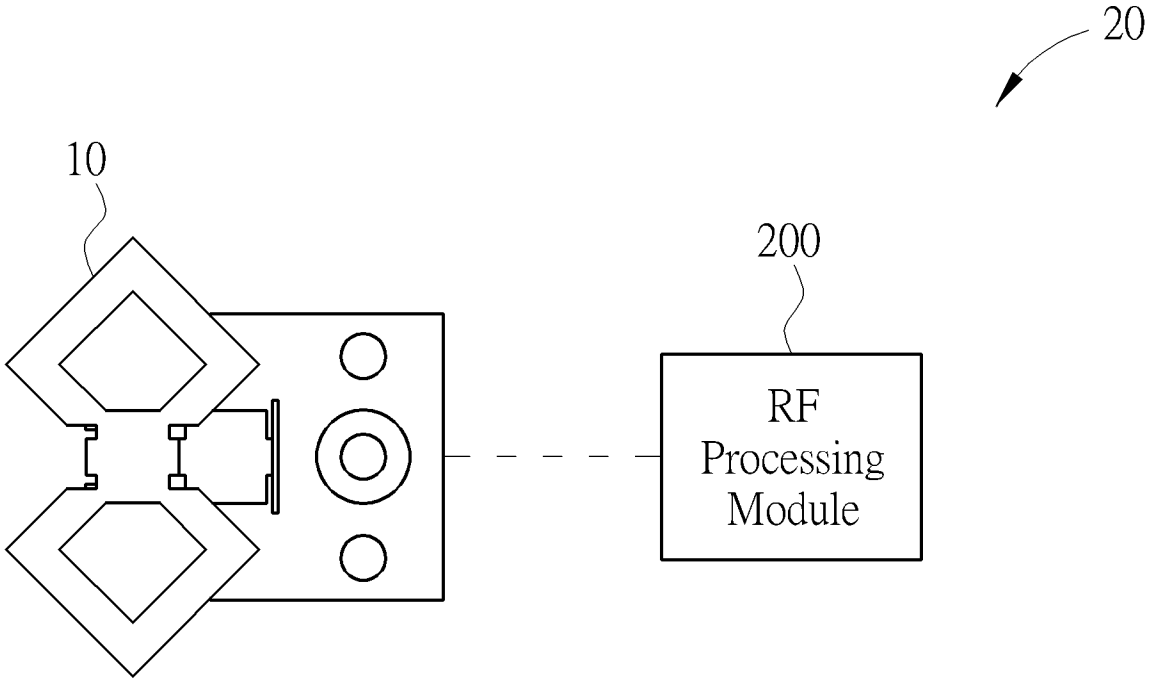
FIG. 2 is a schematic diagram of an antenna system according to an embodiment of the present invention.

In addition, the dual-band antenna 10 may be applied to an antenna system. For example, FIG. 2 is a schematic diagram of an antenna system 20 according to an embodiment of the present invention. The antenna system 20 may be disposed in a wireless device, for example, under a WLAN system. The antenna system 20 comprises a radio frequency (RF) processing module 200 and the dual-band antenna 10. The RF processing module 200 is coupled to the dual-band antenna 10, configured to process RF signals transmitted and received by the dual-band antenna 10.

Notably, the embodiments stated in the above are utilized for illustrating the concept of the present invention. Those skilled in the art may make modifications and alternations accordingly, and not limited herein. For example, the fed-in point 104 of the dual-band antenna 10 is not limited to be at the bottom of the second radiating element 102. The fed-in point 104 may be on the matching element 108, and not limited thereto. In addition, the first radiating element is not limited to be shaped as the double-diamond. As long as the first radiating element has the symmetric structure and has the two edges connected to the central portion, such that the second radiating element is adjacent to the two edges and the central portion of the first radiating element, the requirements of the present invention is satisfied. In addition, a size of the first radiating element may be enlarged or shrunk. In addition, the second radiating element is not limited to be T-shaped, which may be in another kind of geometric shape, such as a circle, a triangle, a trapezoid, etc. As long as the first radiating element is perpendicular to the second radiating element, the requirements of the present invention are satisfied. In addition, the antenna system of the present invention is not limited to comprise only one dual-band antenna. The antenna system may comprise a plurality of dual-band antennas, or comprise a single-band antenna or a multi-band antenna, which is also within the scope of the present invention.

In summary, the dual-band antenna of the present invention utilizes the first radiating element with symmetric structure to transmit wireless signal at the first frequency band, and utilizes the second radiating element perpendicular to the first radiating element to transmit wireless signal at the second frequency band, such that the dual-band antenna achieves dual-band operation in two different polarization directions.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A dual-band antenna, comprising:

a first radiating element parallel to a first plane, operating at a first frequency band, wherein the first radiating element comprises a first radiating part having a first edge and a second radiating part having a second edge, and-the first radiating part and the second radiating part are connected through a central portion to form a symmetric structure, wherein the central portion comprises a planar surface parallel to the first plane;

a second radiating element parallel to a second plane, operating at a second frequency band, adjacent to the first edge, the second edge and a first side of the central portion; and a grounding element, parallel to the first plane; and a shorting element, connected between the grounding element and a second side of the central portion, wherein the second side is opposite to the first side;

wherein the first plane is perpendicular to the second plane.

2. The dual-band antenna of claim 1, wherein the shorting element is parallel to the second plane.

3. The dual-band antenna of claim 1, further comprising:

a matching element, parallel to the first plane; and a connecting element, connected between the matching element and the first side of the central portion.

4. The dual-band antenna of claim 3, wherein the connecting element is parallel to the second plane.

5. The dual-band antenna of claim 1, wherein the second radiating element is substantially in a T-shape.

6. The dual-band antenna of claim 1, wherein the first radiating element is substantially in a shape of a double-diamond.

7. An antenna system, comprising:

at least a dual-band antenna, each comprising:

a first radiating element parallel to a first plane, operating at a first frequency band, wherein the first radiating element comprises a first radiating part having a first edge and a second radiating part having a second edge, and the first radiating part and the second radiating part are connected through a central portion to form a symmetric structure, wherein the central portion comprises a planar surface parallel to the first plane;

a second radiating element parallel to a second plane, operating at a second frequency band, adjacent to the first edge, the second edge and a first side of the central portion; and a grounding element, parallel to the first plane; and a shorting element, connected between the grounding element and a second side of the central portion, wherein the second side is opposite to the first side;

wherein the first plane is perpendicular to the second plane; and a radio frequency (RF) processing module, coupled to the at least a dual-band antenna.

8. The antenna system of claim 7, wherein the shorting element is parallel to the second plane.

9. The antenna system of claim 7, further comprising:

a matching element, parallel to the first plane; and a connecting element, connected between the matching element and the first side of the central portion.

10. The antenna system of claim 9, wherein the connecting element is parallel to the second plane.

11. The antenna system of claim 7, wherein the second radiating element is substantially in a T-shape.

12. The antenna system of claim 7, wherein the first radiating element is substantially in a shape of a double-diamond.

* * * * *